US005318003A

United States Patent [19]

Kadota

[11] Patent Number: 5,318,003

[45] Date of Patent: Jun. 7, 1994

[54] AIR-FUEL RATIO CONTROL UNIT FOR ENGINE

[75] Inventor: Yoichi Kadota, Hyogo, Japan

[73] Assignee: Mitsubishi Denki Kabushiki Kaisha, Tokyo, Japan

[21] Appl. No.: 717,573

[22] Filed: Jun. 19, 1991

[30] Foreign Application Priority Data

Jun. 20, 1990 [JP] Japan ..... 2-163227

[51] Int. Cl.[5] ..... F02M 51/00

[52] U.S. Cl. ..... 123/674; 123/479; 60/276

[58] Field of Search ..... 123/674, 673, 494, 479, 123/434, 681, 693; 60/276; 364/431.05, 431.06

[56] References Cited

U.S. PATENT DOCUMENTS

| | | | |
|---|---|---|---|
| 4,121,548 | 10/1978 | Hattori et al. | 123/479 |
| 4,134,261 | 1/1979 | Iizuka et al. | 60/276 |
| 4,864,998 | 9/1989 | Onishi | 123/494 |
| 4,869,223 | 9/1989 | Shimomura et al. | 123/489 |
| 4,999,781 | 3/1991 | Holl et al. | 364/431.05 |
| 5,001,643 | 3/1991 | Domino et al. | 364/431.06 |
| 5,099,817 | 3/1992 | Nakaniwa | 123/674 |
| 5,131,372 | 7/1992 | Nakaniwa | 123/673 |
| 5,158,062 | 10/1992 | Chen | 123/674 |

FOREIGN PATENT DOCUMENTS 9004090 4/1990 PCT Int'l Appl. .

*Primary Examiner*—Raymond A. Nelli
*Attorney, Agent, or Firm*—Sughrue, Mion, Zinn, Macpeak & Seas

[57] ABSTRACT

An engine air-fuel ratio control unit is so constructed that, whenever any abnormal operation is detected in one of $O_2$ sensors, the control unit makes corrections of a fuel amount injected from an injector on the basis of the output information from the other $O_2$ sensor performing its normal operation and learned values obtained from both of the $O_2$ sensors when both performed their normal operations.

3 Claims, 4 Drawing Sheets

FIG. 2(e) PRESENT INVENTION

AIR-FUEL RATIO CONTROL UNIT FOR ENGINE

BACKGROUND OF THE INVENTION

The present invention relates to an engine air-fuel ratio control unit which is designed to determine a basic fuel amount for controlling the engine to a prescribed air-fuel ratio by arithmetic operations performed on the basis of the information of the intake air amount of the engine and also to correct the signal of the amount of fuel to be fed into the injector, in such a manner as to operate the engine at a theoretical air-fuel ratio, on the basis of the output information from $O_2$ sensors installed respectively on the left and right exhaust banks.

In general, the system to which this type of engine air-fuel ratio control unit is applied, is constructed as illustrated in FIG. 3, in which reference number 1 indicates an engine, reference number 2 indicates an air flow sensor, reference number 3 indicates a throttle valve, reference number 8 indicates an air-fuel ratio control unit, and reference number 9 indicates a revolution sensor which detects the revolutions of the engine 1. Moreover, as the exhaust system is divided between the two banks, namely, the left bank and the right bank, $O_2$ sensors and component parts mentioned in the following are provided each on the left side and the right side. That is, reference number 4 indicates an $O_2$ sensor (right), which performs the detection of the exhaust gas, and reference number 5 indicates an $O_2$ sensor (left), which similarly performs the detection of the exhaust gas. Reference number 6 indicates an injector (right), which performs the injection of the fuel, and reference number 7 indicates an injector (left), which similarly performs the injection of the fuel. Reference number 10 indicates a ternary catalytic converter (right), and reference number 11 indicates a ternary catalytic converter (left).

Moreover, FIG. 4 shows a detailed block construction of the air-fuel ratio control unit 8 shown in the construction drawing of the engine control system in FIG. 3. In FIG. 4, reference number 20 indicates a basic fuel amount calculating means for calculating the basic fuel amount on the basis of the detected amount of an intake air, reference numbers 21 and 22 indicate an A/F feedback correction means, which makes corrections of the air-fuel ratio feedback on the basis of the detected output information from the $O_2$ sensors, and reference number 23 indicates an A/F feedback determining means, which performs control by determining whether the basic fuel amount is to be fed into the injector (right) 6 and the injector (left) 7, respectively, or whether a corrected amount of the fuel as determined by the two systems of the air-fuel feedback correction means 21 and 22 is to be fed into the injectors.

FIG. 5 shows a timing chart illustrating the relationship between the output information from these $O_2$ sensors and the output time widths of the injectors 6 and 7, which are installed respectively on the left bank and the right bank, in case the individual $O_2$ sensors are in their normal state. That is to say, FIG. 5(*a*) shows the waveform of the output from the $O_2$ sensor (right) 4, and FIG. 5(*b*) shows the time duration of fuel injection from the injector (right) 6, which corresponds to the above waveform. As shown in these charts, the air-fuel feedback correction means 21 makes a correction in such a manner as to reduce the amount of the fuel fed, when the signal from the $O_2$ sensor (right) 4 increases and rises above the threshold value voltage $V_1$, which corresponds to the theoretical air-fuel ratio, and, as the result of this correction, the time T for fuel injection (right) from the injector (right) 6 is shortened. Also, when the output from the $O_2$ sensor (right) 4 decreases and falls down below the threshold value voltage $V_1$, the air-fuel feedback correction means 21 makes a correction in such a manner as to increase the amount of the fuel, and, as the result of this correction, the time T for fuel injection (right) from the injector (right) 6 is extended.

In reflection of these results, the waveform of the time T for fuel injection (right) will be such a waveform in amplitude fluctuating upward and downward with respect to the mean value T (right) (central value: the duration of time corresponding to the theoretical air-fuel ratio). Then, the deviations of this amount of feedback correction from the mean value T (right) are constantly renewed and stored in a memory (learning function), and, when the $O_2$ sensor (right) 4 becomes in any abnormal state, the feedback correction is made on the basis of the corrected value (learned value) thus stored in the memory.

Also, the timing relationship between the waveform of the output from the $O_2$ sensor (left) illustrated in FIG. 5 (*c*) and the time for fuel injection (left) from the injector (left) 7 illustrated in FIG. 5(*d*) shows a transition similar to what is described above.

Generally, the ternary catalytic converters will attain the maximum efficiency in their purification of exhaust gas when the air-fuel ratio A/F is 14.7 (the theoretical air-fuel ratio), and their purifying efficiency will be kept at a favorable level by the $O_2$ storage effect if control is performed on the correction of the fuel amount by increasing and decreasing it in a prescribed cycle with reference to the line of the value 14.7 of the air-fuel ratio. On the contrary, the purifying efficiency will become extremely low in case the air-fuel ratio deviates from the proximity of the value 14.7 of the air-fuel ratio or in case control is not performed on the correction of the fuel amount by having it fluctuate upward and downward in relation to the line of the value 14.7 of the air-fuel ratio. In case one of the $O_2$ sensors has a failure, the conventional air-fuel control unit for engine corrects the amount of the fuel for the bank where the failure has occurred by arithmetic operations performed on the basis of the value learned at the time when the failing $O_2$ sensor was in a normal state, and consequently the corrected value will be a certain fixed value. As the result, the conventional unit presents the problem that it is not capable of correcting the amount of the fuel by moving it upward and downward in a prescribed cycle in relation to the line of the value 14.7 of the air-fuel ratio and consequently that it is incapable of effectively purifying the exhaust gas. Additionally, in case a deviation or the like has occurred in the learned value, the conventional unit fails to make any sufficient correction of the amount of the fuel, so that the ternary catalytic converters cannot be utilized effectively.

SUMMARY OF THE INVENTION

With a view to offering a solution to problems described above, the engine air-fuel ratio control unit according to the present invention is so constructed that, whenever any abnormal operation is detected in one of $O_2$ sensors, the control unit makes corrections of fuel amount injected from an injector on the basis of the output information from the other $O_2$ sensor performing its normal operation and learned values obtained from both of the $O_2$ sensors when both performed their normal operations.

DETAILED DESCRIPTION OF THE PREFERRED EMBODIMENTS

The preferred embodiments of the present invention will now be described with reference to the accompanying drawings.

Figure 1:
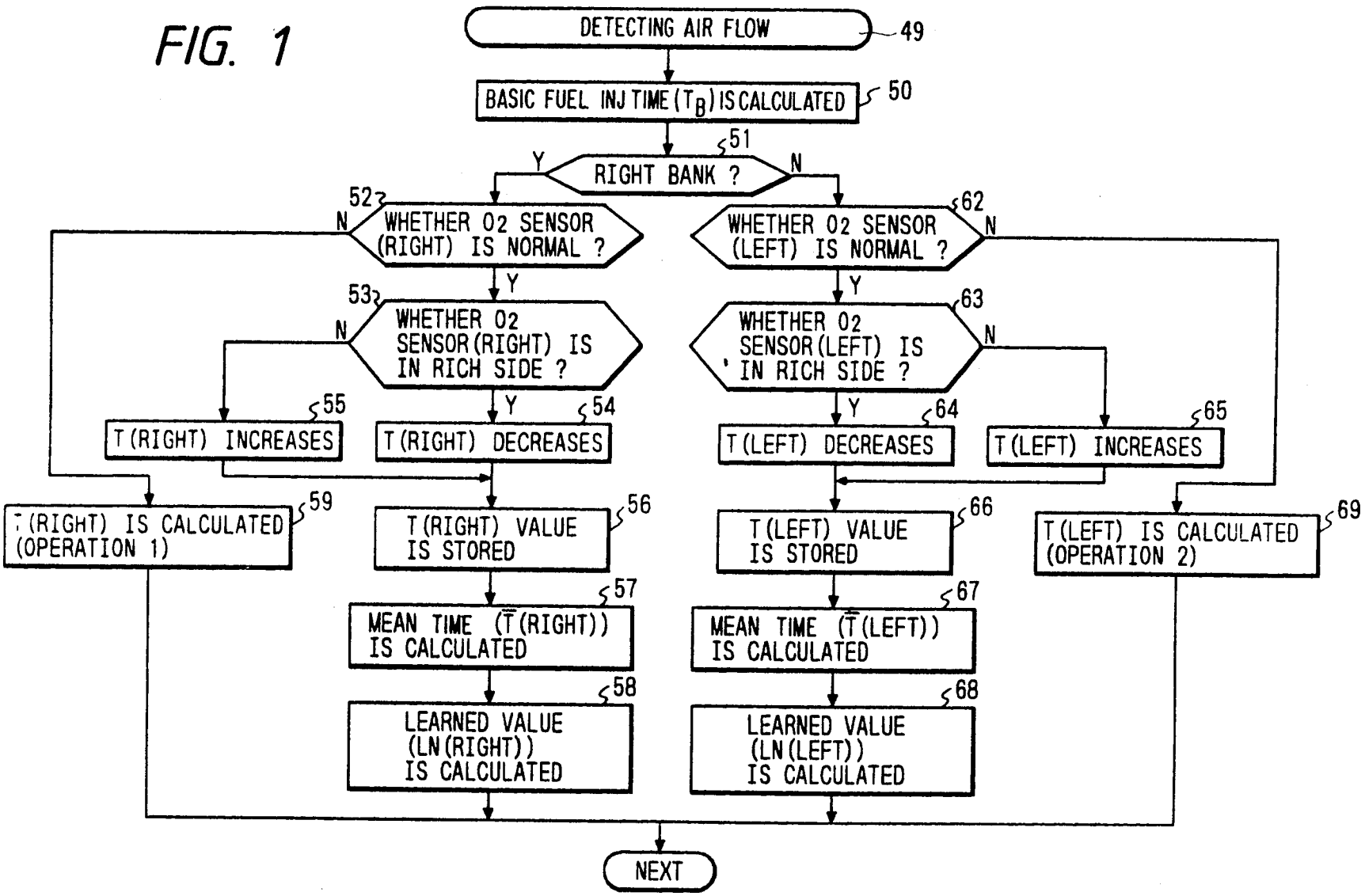
FIG. 1 is a flow chart for illustration of the description of one embodiment of the engine air-fuel ratio control unit according to the present invention.
Figure 3:
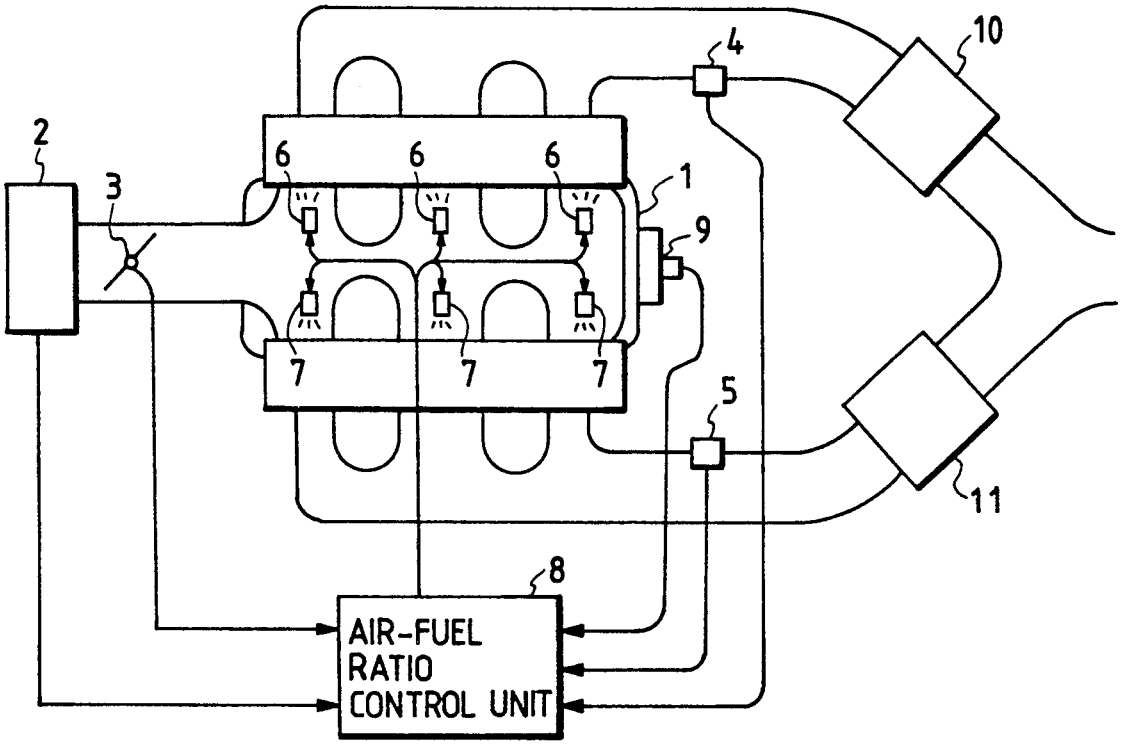
FIG. 3 is a construction view showing a system to which this engine air-fuel ratio control unit is applied.
Figure 4:
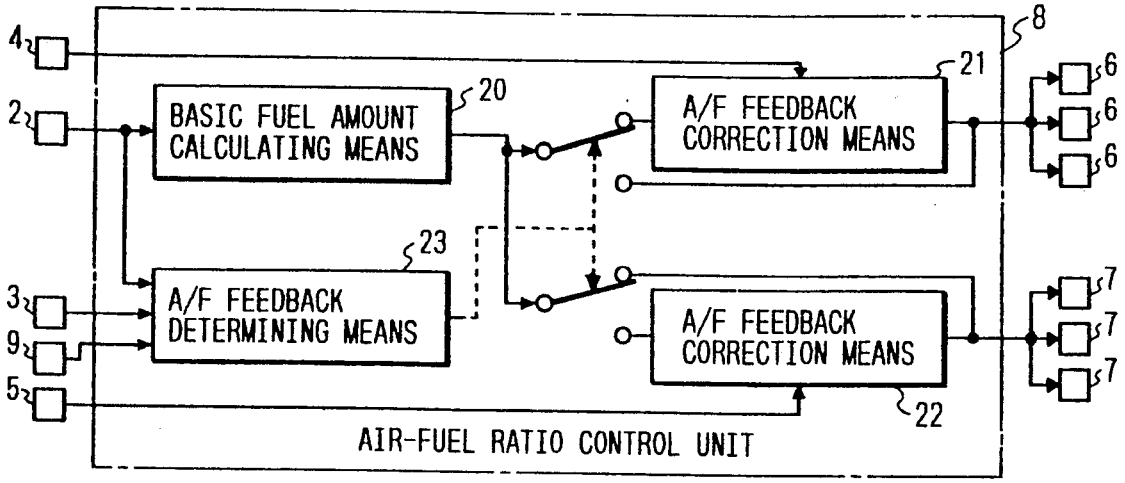
FIG. 4 PRIOR ART
FIG. 4 is a block diagram illustrating a conventional air-fuel ratio control unit for an engine.
Figure 5A:
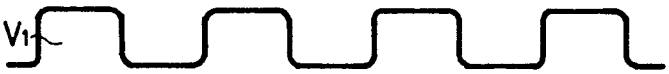
FIG. 5(a) PRIOR ART
FIGS. 5(*a*) through 5(*d*) are timing charts for the conventional unit at the time of its operation in the normal state.
Figure 5B:
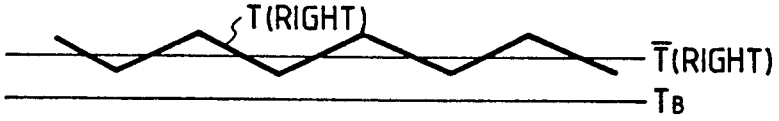
FIG. 5(b) PRIOR ART
Figure 5C:
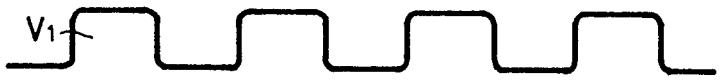
FIG. 5(c) PRIOR ART
Figure 5D:
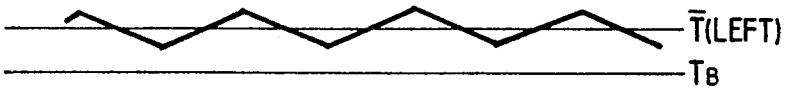
FIG. 5(d) PRIOR ART

FIG. 1 is a flow chart in illustration of the operations of an embodiment of the engine air-fuel ratio control unit according to the present invention. The operations illustrated in this flow chart are applicable to the air-fuel ratio control unit shown in the system construction drawing presented in FIG. 3, and this unit performs its operations for determining the amount of the fuel to be injected by the individual injectors, namely the time periods for the injection of the fuel, separately for the two left and right systems.

In the description to follow, the operations of the engine air-fuel control unit according to the present invention will be described in detail on the basis of the flow chart presented in FIG. 1.

Initially at step 49, the amount of intake air is detected by an air flow sensor 2 and the amount of air is the basis of which a basic amount of fuel is calculated and then a basic fuel injection time ($T_B$) is determined in step 50 by arithmetic operations based on this basic amount of the fuel. Then, at step 51, it is determined whether control is carried out for the right bank, and, in case it is determined that the control is carried out for the right bank, it is determined at step 52 whether or not the $O_2$ sensor (right) 4 is in its nodal state, and, if it is in its nodal state, it is determined at step 53 whether or not the output information from this $O_2$ sensor (right) 4 is on the "rich" side, namely, on the side where the output information is higher than the mean value T (right) (the duration of time corresponding to the value 14.7 of the theoretical air-fuel ratio), and, in case it is found that the result of this determining operation is "Y", the time for fuel injection T (right) is reduced at step 54, so that the duration of time of the injection from the injector right 6 will be thereby reduced, and the operation shifts to step 56. Also, in case the output from the $O_2$ sensor (right) 4 indicates a value not on the rich side but on the lean side, it is determined "N" at step 53, in which case the time for fuel injection T (right) for the injector (right) 6 is increased at step 55, and the operation shifts thereafter to step 56.

When the calculation of the time for fuel injection T (right) is completed in this manner for the fuel injected from the injector (right) 6, this value T (right) is stored in a memory at step 56, and, subsequently at step 57, the mean time for fuel injection T (right) is calculated on the basis of the value T (right) just found and the value T (right) for the previous time for fuel injection, and a learned value (LN (right)) is determined by arithmetic operations based on this mean value and is stored in the memory.

On the other hand, it is determined "N" at step 52 in case the $O_2$ sensor (right) 4 is in any abnormal state, and, in this case, the operation 1 for determining the time width for fuel injection T (right) by arithmetic operations based on the learned value, is performed at step 59.

TABLE

| | Conventional Control Unit | Control Unit according to the Present Invention |
|---|---|---|
| Operation 1 | T (right) = $T_B$ * LN (right) | T (right) = T (left) * (LN (right)/LN (left)) |
| Operation 2 | T (left) = $T_B$ * LN (left) | T (left) = T (right) * (LN (left)/LN (right)) |

The table given above shows a comparison between the conventional control operations and the operations according to the present invention with respect to the operation 1 described above and the operation 2 to be described below. That is, the time for fuel injection T (right) for the injector (right) 6 at the time when the $O_2$ sensor (right) 4 is in an abnormal state is determined by the conventional method in the manner expressed in the following equation:

$$T\,(\text{right}) = T_B \times LN\,(\text{right}) \quad (1)$$

Wherein, $T_B$ is the time for fuel injection which corresponds to the basic fuel amount, and LN (right) is the learned value at the time when the $O_2$ sensor (right) is in the normal state.

On the other hand, in the operation according to the present invention, the operation is performed to determine the time for fuel injection T (right) by arithmetic operations in the manner expressed in the following equation:

$$T\,(\text{right}) = T\,(\text{left}) \times (LN\,(\text{right})/LN\,(\text{left})) \quad (2)$$

Wherein, T (left) is the time for fuel injection from the injector (left) 7 at the time when the $O_2$ sensor (left) 5 is in its normal state, and LN (left) is the learned value thereof.

Then, in case it is determined at step 51 that the control is carried out for the left bank side, it is determined at step 62 whether or not the $O_2$ sensor (left) 5 is in its normal state, and, if it is normal, it is determined at step 63 whether or not the output information from this $O_2$ sensor (left) 5 is on the rich side, namely, whether it is at a level higher than the mean value T (left), and, in case the result as thus determined is "Y", the time for fuel injection T (left) is reduced at step 64, so that the time for fuel injection from the injector (left) 7 is thereby shortened, and the operation shifts to step 66. Also, in case the output from the $O_2$ sensor (left) 5 is found to be not on the rich side but on the lean side, it is determined "N" at step 63, in which case the time for fuel injection T (left) from the injector (left) 7 is increased at step 65, and the operation shifts to step 66.

When the arithmetic operations to determine the time for fuel injection T (left) are completed for the fuel injected from the injector (left) 7, the value T (left) thus determined is stored in the memory at step 66, and, subsequently at step 67, the mean time for fuel injection T (left) is found by arithmetic operations at step 67 on the basis of the value T (left) just determined and the previously registered value for the time for fuel injection T (left), and a learned value (LN (left)) is calculated from this mean value and stored in the memory.

On the other hand, it is determined at step 62 that the state is "N" in case the $O_2$ sensor (left) 5 is in any abnormal state, and, in this case, the system executes the operation 2, which determines the time for fuel injection T (left) by arithmetic operations at step 69 on the basis of the learned value.

In this case, the time for fuel injection T (left) from the injector (left) 7 at the time when the $O_2$ sensor (left) 5 is in its abnormal state, is conventionally determined by the operation expressed in the following equation in the same manner as described above:

$$T\,(\text{left}) = T_B \times LN\,(\text{left}) \quad (3)$$

On the other hand, the time for fuel injection T (left) according to the present invention is determined by arithmetic operations expressed in the following equation:

$$T\,(\text{left}) = T\,(\text{right}) \times (LN\,(\text{left})/LN\,(\text{right})) \quad (4)$$

Wherein, T (right) is the time for fuel injection from the injector (right) 6 at the time when the $O_2$ sensor (right) 4 is in its normal state, and LN (right) is the learned value thereof.

Figures 2A, 2B, 2C, 2D:
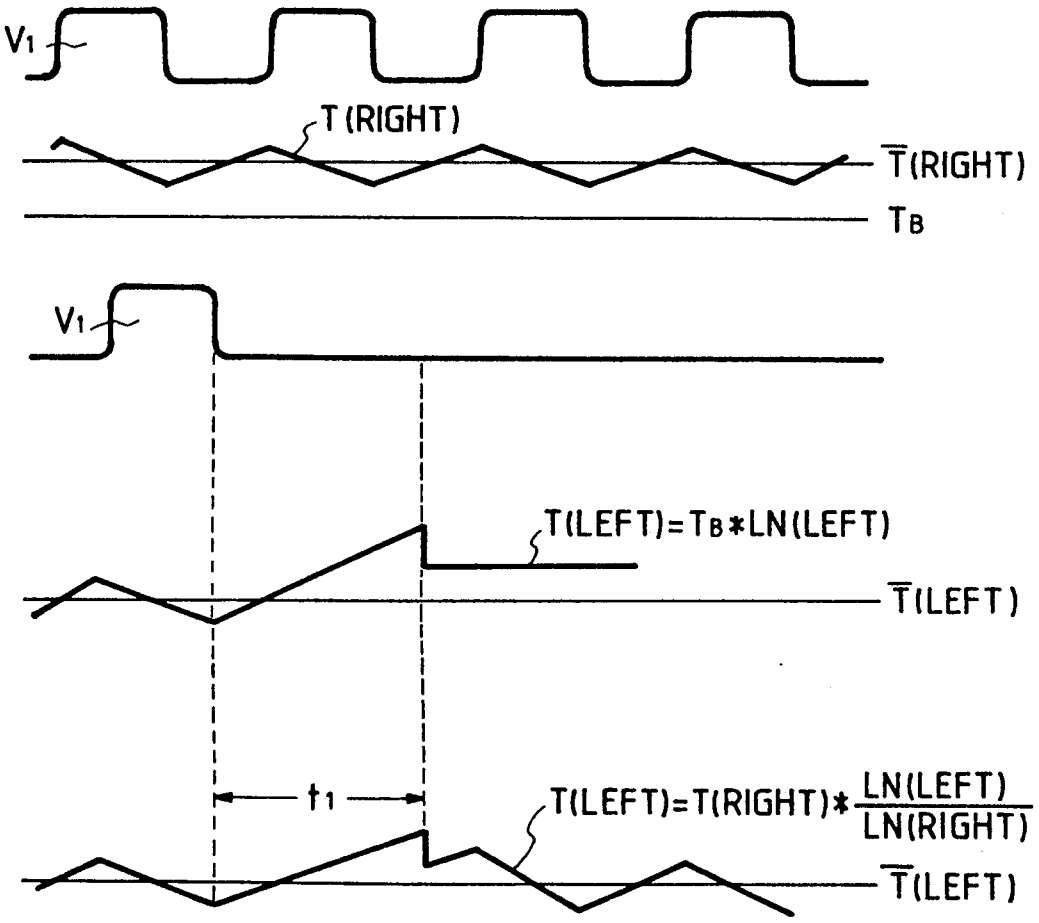
FIG. 2(d) PRIOR ART
FIGS. 2(*a*) through 2(*e*) are timing charts for an air-fuel ratio control unit in which FIG. 2(*d*) shows a time period according to a conventional unit and FIG. 2(*e*) shows a time period according to the present invention.

The timing chart presented in FIG. 2 illustrates a case in which the $O_2$ sensor (left) 5 gets into an abnormal state while the $O_2$ sensor (right) 4 is in operation in its normal state.

In this case, the time for fuel injection T (left) from the injector (left) 7 in the conventional unit takes a fixed time as shown in FIG. 2(*d*) after the elapse of the time $t_1$ and is also corrected-with a fixed deviation and a fixed direction in a state with a deviation from the mean value T (left), in case the $O_2$ sensor (left) 5 gets into any abnormal state. In contrast, it can be understood that the control unit according to the present invention makes upward and downward corrections centering around the mean value T (left) in a prescribed cycle and with a fixed deviation as illustrated in FIG. 2(*e*).

As described in the foregoing part, the air-fuel ratio control unit according to the present invention is capable of making sufficient corrections of the amount of the fuel, thereby utilizing the ternary catalytic converters in such a manner as to achieve their optimum purifying efficiency, even if there is any deviation in the learned values, because the control unit is so constructed that, in case one of the $O_2$ sensors has any trouble, the control unit determines the amount of the fuel to be injected from the injector of the bank system in trouble on the basis of the learned values found for the two bank systems when the $O_2$ sensor currently in trouble was in its normal-state operation and the fuel amount supplied based on the feedback correction of the air-fuel ratio to the injector of the other normal bank system. Additionally, the control unit is capable of purifying the exhaust gas in an effective way because the control unit makes corrections by increasing or decreasing the amount of the fuel in the feedback cycle, which increases the chances of the corrected fuel amount crossing the line corresponding to the value of 14.7 of the theoretical air-fuel ratio, and also because the unit can take advantage of the $O_2$ storage effect. In addition, the air-fuel control unit is capable of dealing properly with the secular changes of the engine, even if one of the $O_2$ sensors has a failure, so long as the other $O_2$ sensor remains in its normal state.

As is apparent from the description given above, the engine air-fuel ratio control unit according to the present invention is designed to make corrections of the fuel amount, in case any abnormal operation has been detected in one of the $O_2$ sensors, on the basis of the output information from the other $O_2$ sensor performing its normal operation and the learned values acquired at the time when both of the $O_2$ sensors were in their normal-state operation. Hence, even in a case in which any deviation has occurred in the learned values, the air-fuel ratio control unit is capable of making sufficient corrections of the fuel amount, thereby utilizing the ternary catalytic converters in an effective way and also making corrections of the fuel amount with its periodic increases and decreases, so that the air-fuel ratio control unit can achieve the effect that the control unit can perform its highly efficient purification of the exhaust gas owing to the $O_2$ storage effect.

What is claimed is:

1. An air-fuel ratio control unit for a V-type engine, comprising:

means for calculating a basic fuel injection time on the basis of an intake air amount detected by an air flow sensor and for generating a fuel feeding instruction signal to an injector installed in an air intake pipe;

air-fuel ratio feedback correction means for correcting a fuel injection time of said injector in such a manner that said engine is operated at a theoretical air-fuel ratio, on the basis of output information form $O_2$ sensors installed respectively on left and right exhaust banks;

learning means for storing a learned value representing a deviation of the basic fuel injection time for each of the exhaust banks from a mean fuel injection time; and means for, in case one of said $O_2$ sensors becomes in any abnormal state, correcting the fuel injection time on the basis of the output information from another $O_2$ sensor operating in a normal state, and the learned values stored in said learning means at a time when both of said $O_2$ sensors were in a normal state.

2. An engine air-fuel control unit according to claim 1, wherein said theoretical air-fuel ratio is 14.7.

3. A method of controlling an air-fuel ratio for an engine installed with at least two exhaust banks each having an $O_2$ sensor, comprising the steps of:

calculating a basic fuel injection time on the basis of an amount of intake air detected by an air flow sensor;

calculating a fuel injection time of an injector on the basis of an output information from said each $O_2$ sensor;

calculating a mean fuel injection time for said each $O_2$ sensor;

storing a learned value for said each $O_2$ sensor on the basis of the basic fuel time and the means fuel injection time; and correcting, in case one of said $O_2$ sensors becomes in any abnormal state, the fuel injection time on the basis of the output information from the other $O_2$ sensor performing its normal operation and the learned values stored at the time when both the $O_2$ sensors performed normal operations.

* * * * *